US005124678A

United States Patent [19]

Yamat et al.

[11] Patent Number: 5,124,678

[45] Date of Patent: Jun. 23, 1992

[54] INTERRUPTER ACTUATOR

[75] Inventors: Miguel B. Yamat, Franklin; Timothy J. Tythcott, New Berlin, both of Wis.

[73] Assignee: Cooper Power Systems, Inc., Houston, Tex.

[21] Appl. No.: 683,087

[22] Filed: Apr. 10, 1991

Related U.S. Application Data

[63] Continuation of Ser. No. 245,367, Sep. 19, 1988, abandoned.

[51] Int. Cl.[5] ..... H01H 71/10

[52] U.S. Cl. ..... 335/9; 335/21; 335/172

[58] Field of Search ..... 200/144 B; 335/8-10, 335/37, 170-174, 21

[56] References Cited

U.S. PATENT DOCUMENTS 3,098,910 7/1963 Schwartz ..... 335/9

4,591,679 5/1986 Yamat et al. ..... 200/144 B 4,791,364 12/1988 Milkuecky ..... 335/170

*Primary Examiner*—J. R. Scott

*Attorney, Agent, or Firm*—Michael, Best & Friedrich

[57] ABSTRACT

An interrupter actuator comprising a frame, a pivot lever mounted on the frame for pivotal movement relative thereto about a first axis and between first and second positions, an operating lever mounted on the pivot lever for pivotal movement relative thereto about a second axis spaced from the first axis, and the operating lever being moveable between an open position and a closed position, and a linkage for opening an interrupter in response to movement of the operating lever when the pivot lever moves to the second position, for opening the interrupter in response to movement of the operating lever to the open position when the pivot lever is in the first position, and for closing the interrupter in response to movement of the operating lever to the closed position when the pivot lever is in the first position.

19 Claims, 3 Drawing Sheets

INTERRUPTER ACTUATOR

This application is a continuation of U.S. Pat. application Ser. No. 07/245,367, filed Sep. 19, 1988, now abandoned.

RELATED APPLICATION

Attention is directed to U.S. Pat. No. 4,591,679, issued May 27, 1986 and assigned to the assignee hereof.

BACKGROUND OF THE INVENTION

The invention relates to apparatus for actuating switches or interrupters, and more particularly to manually operable apparatus for actuating interrupters.

U.S. Pat. No. 4,591,679 (hereinafter "the '679 patent") discloses a manually operable switch actuator. The switch actuator of the '679 patent is not suitable for use with an interrupter because it does not include means for automatically opening or tripping an interrupter in the event of a fault.

SUMMARY OF THE INVENTION

The interrupter actuator claimed herein includes elements corresponding to many of the elements of the switch actuator of the '679 patent. The interrupter actuator of the invention comprises a frame, and a first or switch operating lever (corresponding to the link 38 of the '679 patent) pivotally movable about an axis (corresponding to the pin 44 of the '679 patent) and between open and closed positions. The actuator also comprises an actuating member or yoke (corresponding to the yoke 42 of the '679 patent) pivotally mounted on the frame, and a spring (corresponding to the spring 54 of the '679 patent) connected between the switch-operating lever and the yoke. The yoke is manually movable relative to the frame between a first position wherein the spring biases the switch-operating lever in one direction or toward the open position and a second position wherein the spring biases the switch-operating lever in the other direction or toward the closed position. The actuator also comprises a linkage (corresponding to the lever 25 and link 40 of the '679 patent) for opening an interrupter in response to movement of the switch-operating lever to the open position and for closing the interrupter in response to movement of the switch-operating lever to the closed position.

Unlike in the '679 patent, however, the switch-operating lever is selectively and releasably connected to the frame. Alternatively stated, the actuator comprises selectively releasable means for retaining the axis against movement relative to the frame. More particularly, in the preferred embodiment, the actuator also comprises a second or pivot lever connected to the frame for pivotal movement relative thereto between first and second positions, and selectively releasable means for retaining the pivot lever in its first position. The switch-operating lever is connected to the pivot lever for pivotal movement relative thereto about the axis. The switch-operating lever is also connected to the pivot lever such that, when the pivot lever is released from its first position, the switch-operating lever moves to a third position, under the influence of the spring, so as to open the interrupter via the above-described linkage and so as to move the pivot lever to its second position.

The selectively releasable means for retaining the pivot lever in its first position includes a third or trip lever which is mounted on the frame for pivotal movement relative thereto between retaining and non-retaining positions, which operates to retain the pivot lever in its first position when the trip lever is in its retaining position, and which permits movement of the pivot lever to its second position under the influence of the spring when the trip lever is in its non-retaining position. The trip lever is moved between its retaining and non-retaining positions by a sensor-tripper apparatus such as the apparatus disclosed in U.S. Pat. No. 4,791,394 which is incorporated herein by reference.

Thus, the interrupter is opened either in response to movement of the switch-operating lever to its third position when the pivot lever moves to its second position or in response to movement of the switch-operating lever to its open position when the pivot lever is in its first position. The interrupter is closed in response to movement of the switch-operating lever to its closed position when the pivot lever is in its first position.

The invention also provides a three-phase electrical apparatus comprising first, second and third-phase circuits respectively including first, second and third switches or interrupters, and first, second and third manually operable actuators (as described above) respectively connected to the first, second and third interrupters. The actuators include first, second and third sensor-tripper apparatus respectively connected to the first, second and third circuits for detecting faults therein, and an arrangement for tripping all three of the actuators to open all three of the interrupters in response to detection of a fault by any one of the first, second and third sensor-trippers. Rather than using the force of a single sensor-tripper to trip all three actuators, this arrangement utilizes the opening force of the first actuator to be tripped in order to trip the other two actuators. Therefore, the force required of each sensor-tripper is minimized.

More particularly, this arrangement includes a shaft on which the above-described trip lever of each of the three actuators is pivotally mounted. This arrangement also includes, for each of the actuators, a fourth or driving lever that is fixed to the shaft for common rotation therewith. The driving lever is arranged relative to the associated actuator so that tripping of the associated actuator by pivotal movement of the associated trip lever causes pivotal movement of the driving lever and thereby pivotal movement of the shaft and of the other two driving levers. Each driving lever is also arranged so that pivotal movement of the driving lever causes pivotal movement of the associated trip lever from its retaining position to its non-retaining position and thereby trips the associated actuator. Thus, the tripping of any one actuator utilizes the opening force of that actuator to trip the other two actuators.

A principal feature of the invention is the provision of a switch actuator which functions like the switch actuator of the '679 patent but which is also suitable for use as an interrupter actuator.

Another principal feature of the invention is an interrupter actuator which minimizes the magnetic force required from the sensor-tripper.

Another principal feature of the invention is the provision of a three-phase electrical apparatus comprising three actuators including respective sensor-trippers, and means for tripping all three of the actuators in response to detection of a fault by any one of the sensor-trippers, wherein the opening force of the first actuator to be tripped is used to trip the other two actuators. This also minimizes the force required of the sensor-trippers.

Other features and advantages of the invention will become apparent to those skilled in the art upon review of the following detailed description, claims and drawings.

Figure 3:
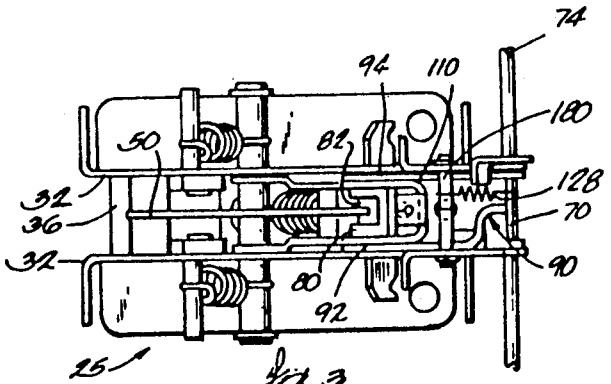
FIG. 3 is a top view of the apparatus as shown in FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An electrical apparatus 2 embodying the invention is illustrated in the drawings.

The apparatus 2 comprises an interrupter 6. The interrupter 6 includes a sealed housing 8 which is mounted on end plates 10 and 12 and which houses fixed and movable contacts 18 and 20 (shown schematically in FIGS. 4–6). The movable contact 20 is mounted on an actuator rod 22 for movement into and out of engagement with the fixed contact 18.

Figure 2:
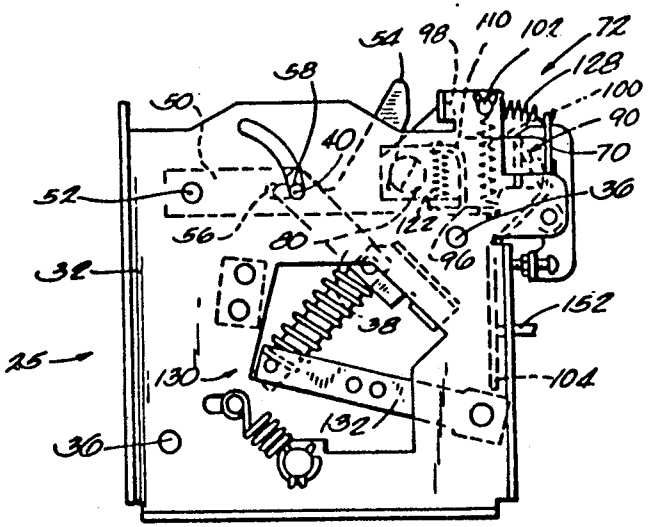
FIG. 2 is a partial side elevational view, with some elements removed, of the apparatus.

The apparatus 2 also comprises a switch or interrupter actuator 25. The actuator 25 comprises a housing or frame 30 formed by two side plates 32 which are mounted on the end plate 10 via connecting members 33 and which are held in spaced relation by spacers 36. The actuator 25 also comprises a first or switch-operating lever 38 pivotally movable about an axis 40 and between open (FIGS. 2 and 4) and closed (FIG. 5) positions.

Figure 1:
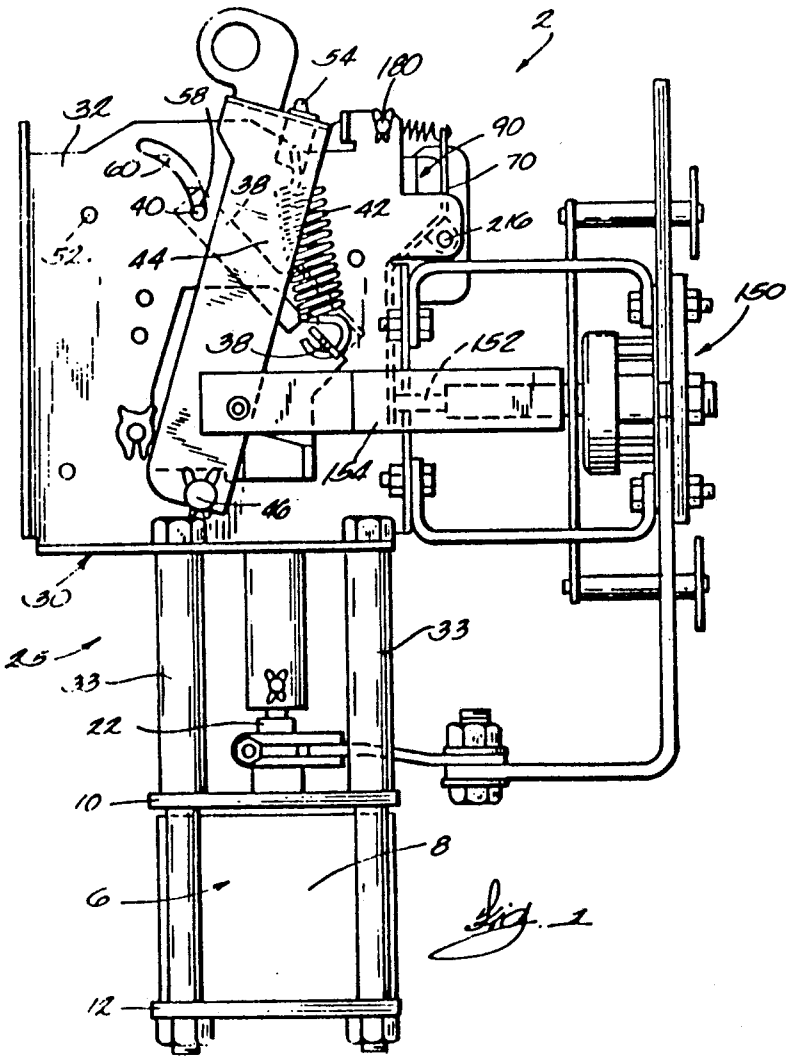
FIG. 1 is a side elevational view of an apparatus embodying various features of the invention.

The actuator 25 also comprises manually operable means for causing pivotal movement of the switch-operating lever 38 about the axis 40 and between the open and closed positions. While various suitable means can be employed, in the preferred embodiment, such means includes spring means connected to the switch-operating lever 38 at a point spaced from the axis 40. While various suitable spring means can be used, in the illustrated construction, such means includes a tension spring 42 having a lower end connected to the switch-operating lever 38 adjacent the lower end thereof. The upper end of the spring 42 is connected to the below-described yoke 44. The manually operable means also includes means for moving the spring 42 over-center of the lever 38 or over the axis 40. The means for moving the spring 42 over the axis 40 preferably includes an actuating member or yoke 44 (FIG. 1) pivotally mounted on the frame 30. Preferably, the yoke 44 is mounted on the frame 30 for pivotal movement about a pivot pin 46. The upper end of the spring 42 is connected to the yoke 44 adjacent the upper end thereof, as mentioned above, and the yoke 44 is pivotally movable relative to the frame 30 between a first or right or open position (FIG. 1) wherein the spring 42 biases the switch-operating lever 38 in one direction or toward the open position and a second or left or closed position (not shown) wherein the spring 42 biases the switch-operating lever 38 in the other direction or toward the closed position.

The actuator 25 also comprises selectively releasable means for retaining the axis 40 against movement relative to the frame 30 or to the plates 32. While various suitable selectively releasable means can be employed, in the preferred embodiment, such means includes a second or pivot lever 50 connected to the frame 30 for pivotal movement relative thereto between first (FIGS. 2, 4 and 5) and second (FIG. 6) or lower and upper positions. The pivot lever 50 is pivotally mounted on a pin 52 supported by the frame 30 and has thereon an upwardly extending projection 54, the reason for which is explained hereinafter. The switch-operating lever 38 is connected to the pivot lever 50 for pivotal movement relative thereto about the axis 40. More particularly, the pivot lever 50 has therein a slot 56 (FIG. 2), and the switch-operating lever 38 is connected to a pivot pin 58 slidably housed in the slot 56. Furthermore, the side plates 32 have therein (see FIGS. 1 and 2) aligned, arcuate slots 60 slidably housing the opposite ends of the pin 58. The slot 56 and the slots 60 cooperate to locate the pivot pin 58 and thus the axis 40 in a fixed position for any given position of the pivot lever 50. Therefore, the position of the axis 40 is fixed when the pivot lever 50 is in its lower position. Also, the switch-operating lever 38 is movable relative to the pivot lever 50 between the open position (FIGS. 2 and 4) and the closed position (FIG. 5).

Because of the connection of the switch-operating lever 38 to the first lever 50, the spring 42 acts through the switch-operating lever 38 to bias the pivot lever 50 toward its second or upper position. Therefore, the selectively releasable means for retaining the axis 40 also includes selectively releasable means for retaining the pivot lever 50 in its lower position. While various suitable means can be used for retaining the pivot lever 50 in its lower position, in the illustrated construction, such means includes a third or trip lever 70 mounted on the frame 30 for pivotal movement between a retaining position (FIGS. 1–5) and a non-retaining position (FIG. 6), and means 72 for retaining the pivot lever 50 in its lower position when the trip lever 70 is in its retaining position. The trip lever 70 is preferably pivotally mounted on a shaft 74 which is supported by the frame 30.

While various suitable means 72 can be employed for retaining the pivot lever 50 in its lower position when the trip lever 70 is in its retaining position, in the preferred embodiment, the means 72 includes a shaft 80 which is pivotally mounted on the frame 30 and which has a D-shaped or semicylindrical section 82 (FIGS. 3–6). The shaft 80 is pivotable between a retaining position (FIGS. 2–5) wherein the D-shaped section 82 of the shaft 80 engages the right end of the pivot lever 50 and retains the pivot lever 50 in its lower position, and a non-retaining position (FIG. 6) wherein the D-shaped section 82 of the shaft 80 permits movement of the pivot lever 50 to its upper position. The means 72 also includes an actuating lever 90 which is rotatable relative to the shaft 80 and between a first or lower position (FIGS. 2-5) and a second or upper position (FIG. 6), and which includes (see FIGS. 3 and 7) spaced, parallel portions 92 and 94 connected by a cross portion 96. The portions 92 and 94 have thereon aligned, upwardly extending projections 98, the reason for which is explained hereinafter. The means 72 also includes means for biasing the actuating lever 90 counter-clockwise or to its upper position. This biasing means preferably includes a spring 100 extending between the cross portion 96 and a pin 102 mounted on the frame 30. The means 72 also includes a lever or bracket 110 which is fixed to the shaft 80, which is located between the portions 92 and 94 of the actuating lever 90 and which extends above the cross portion 96 of the actuating lever 90. A spring 122 extends between the cross portion 96 of the actuating lever 90 and the lever 110 and biases the lever 110 clockwise relative to the lever 90 so that the lever 110 normally contacts the cross portion 96 of the actuating lever 90. Consequently, counter-clockwise pivotal movement of the actuating lever 90 from its lower position to its upper position causes counter-clockwise pivotal movement of the lever 110 and counter-clockwise pivotal movement of the shaft 80 so that the shaft 80 moves to its non-retaining position and thereby releases the pivot lever 50 from its lower position.

Figure 5:
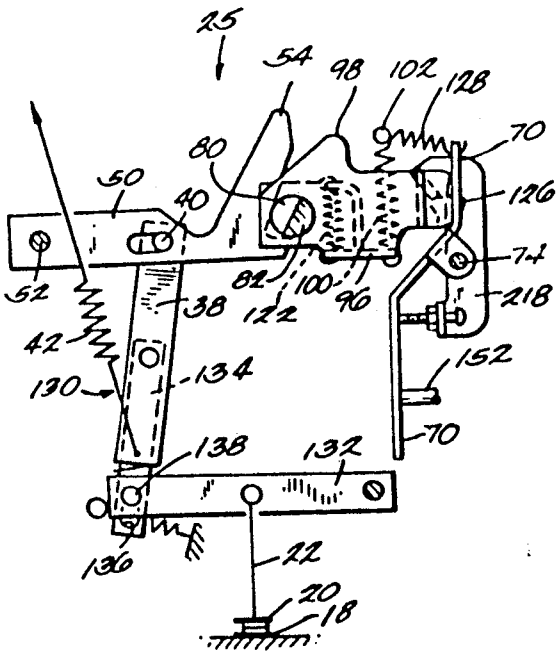
Figure 4:
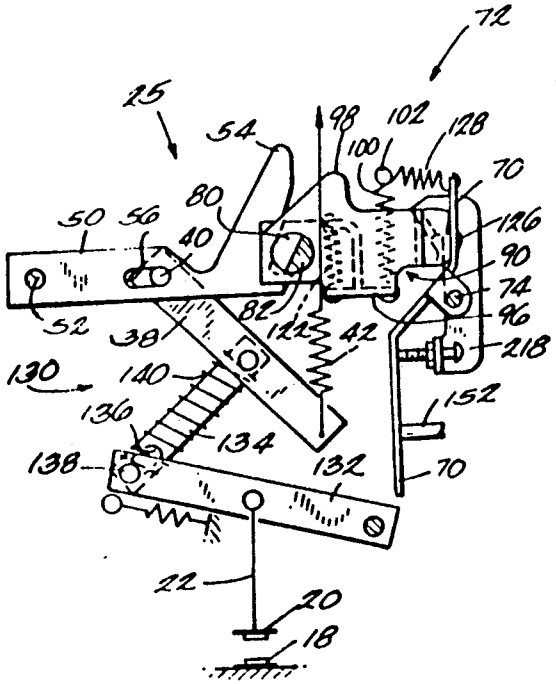

When the shaft 80 is in its retaining position and the trip lever 70 is in its retaining position, as shown in FIGS. 4 and 5, the trip lever 70 engages the portion 92 of the actuating lever 90 so as to retain the actuating lever 90 in its lower position. More particularly, the trip lever 70 has therein an aperture 124 (FIG. 7), and the portion 92 of the lever 90 has thereon a projection 126 (FIGS. 4-7) that extends into the aperture 124. When the trip lever 70 moves clockwise from its retaining position to its non-retaining position (FIG. 6), the trip lever 70 disengages the actuating lever 90 and permits counter-clockwise pivotal movement of the actuating lever 90 to its upper position under the influence of the spring 100. This in turn moves the lever 110 so that the shaft 80 moves to its non-retaining position and thus permits movement of the pivot lever 50 to its upper position.

The means 72 for retaining the pivot lever 50 in its lower position also includes means for biasing the trip lever 70 counter-clockwise or to its retaining position. The means biasing the trip lever 70 to its retaining position preferably includes a spring 128 extending between the pin 102 and the upper end of the trip lever 70.

The actuator 25 also comprises means for opening and closing the interrupter 6 in response to pivotal movement of the switch-operating lever 38 about the axis 40. While various suitable means can be employed, in the preferred embodiment, such means includes linkage means 130 including a switch lever 132 pivotally mounted on the frame 30 and pivotally connected to the actuator rod 22 of the interrupter 6, and a link 134 connected to the switch-operating lever 38 and to the switch lever 132. In the illustrated construction, the link 134 has therein a slot 136 which receives a pin 138 on the switch lever 132 so as to provide a lost motion connection between the link 134 and the switch lever 132. The linkage means 130 also includes a compression spring 140 (FIGS. 4 and 6) mounted on the link 134 so as to bias the connection of the switch-operating lever 38 and the link 134 away from the connection of the link 134 and the switch lever 132. The switch lever 132, link 134 and spring 140 are substantially identical to the link 25, link 40 and spring 64, respectively, of the '679 patent.

When the pivot lever 50 is in its first or lower position, movement of the switch-operating lever 38 to its open position (in response to movement of the yoke 44, as described above) acts through the link 134 to cause upward movement of the switch lever 132 and thereby opens the interrupter 6. During movement of the switch-operating lever 38 to its closed position when the pivot lever 50 is its first or lower position, the lever 38 acts through the link 134 to cause downward movement of the switch lever 132 and thereby closes the interrupter 6. Thus, the linkage means 130 opens the interrupter 6 in response to movement of the switch-operating lever 38 to its open position when the pivot lever 50 is in its lower position, as shown in FIG. 4, and closes the interrupter 6 in response to movement of the switch-operating lever 38 to its closed position when the pivot lever 50 is in its lower position, as shown in FIG. 5.

The actuator 25 also comprises means for releasing the means retaining the pivot lever 50 in its lower position, i.e., for releasing the means for retaining the axis 40, in response to a fault in a circuit connected to the interrupter 6. While various suitable means can be employed, in the preferred embodiment, such means includes a sensor-tripper apparatus 150. The sensor-tripper 150 is substantially identical to the apparatus disclosed in U.S. Pat. No. 4,791,394, which has been incorporated herein by reference. The sensor-tripper 150 is mounted on the frame 30 and includes an actuating member or trip rod 152 (corresponding to the trip rod 14 of U.S. Pat. No. 4,791,394) that is movable into engagement with the trip lever 70 for moving the trip lever 70 from its retaining position to its non-retaining position. The sensor-tripper 150 also includes a reset member 154 (corresponding to the member 100 of U.S. Pat. No. 4,791,394) which is connected to the yoke 44 and which resets the sensor-tripper 150 when the yoke 44 is moved to the right or to its open position.

Figure 6:
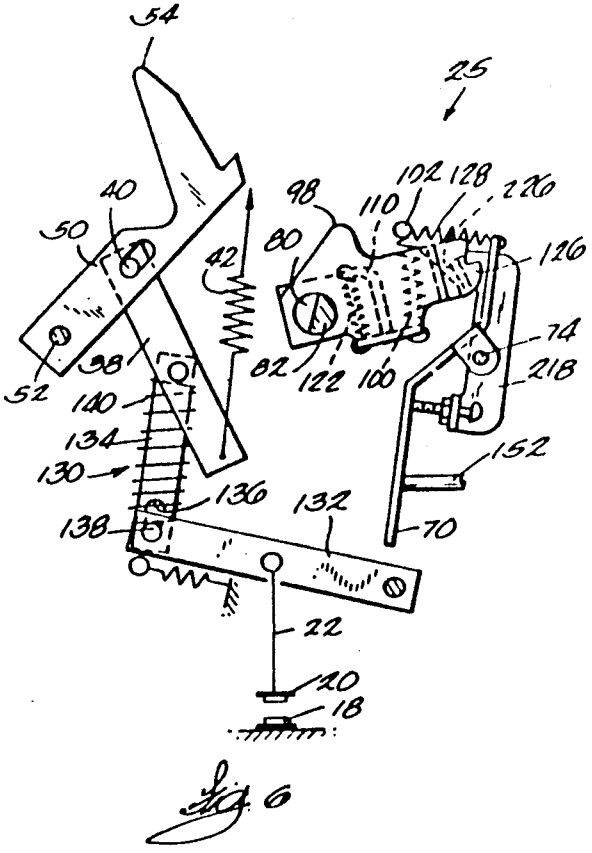
FIG. 4–6 are schematic views of various stages of operation of the apparatus.

The actuator 25 also comprises means for opening the interrupter 6 in response to the release of the means for retaining the axis 40, i.e., for opening the interrupter 6 in response to the release of the pivot lever 50 from its lower position. This means includes the switch-operating lever 38, the spring 42, the link 134, the spring 140 and the switch lever 132. More particularly, when the yoke 44 is in its closed position, the spring 42 biases the switch-operating lever 38 toward its closed position and thus biases the pivot lever 50 toward its upper position, and the release of the pivot lever 50 from its lower position permits upward movement of the switch-operating lever 38 relative to the frame 30 and pivotal movement of the lever 38 to a third position (different from the open and closed positions) relative to the pivot lever 50. Such movement of the lever 38 causes upward movement of the link 134 and the switch lever 132 and thereby opens the interrupter 6. This is shown in FIG. 6. Thus, the linkage means 130 opens the interrupter 6 in response to movement of the switch-operating lever 38 when the pivot lever 50 moves to its upper position.

The actuator 25 operates as follows. When the pivot lever 50 is in its lower position and the switch-operating lever 38 is in its closed position, the interrupter 6 is closed. From this state, as shown in FIG. 5, the interrupter 6 can be opened in either of two ways. First, the interrupter 6 can be opened manually by moving the yoke 44 clockwise or to its open position (shown in FIG. 1). The causes the spring 42 to move over-center and move the switch-operating lever 38 to its open position. Such movement of the switch-operating lever 38 operates, as described above, to open the interrupter 6. This is shown in FIG. 4. Second, the interrupter 6 can be opened by the sensor-tripper 150. When the sensor-tripper 150 detects a fault, the trip rod 152 moves to the left and engages the trip lever 70 to move the trip lever 70 clockwise. This operates, as described above, to release the pivot lever 50 from its lower position so that the pivot lever 50 moves counterclockwise under the influence of the spring 42. Such movement of the pivot lever 50 operates, as described above, to open the interrupter 6. This is shown in FIG. 6.

The actuator 25 is reset after the yoke 44 has been moved to its open position simply by moving the yoke 44 counter-clockwise or to its closed position. This returns the switch operating lever 38 to its closed position and thereby closes the interrupter 6.

The actuator 25 is reset after it has been tripped by the sensor-tripper 150 by first moving the yoke 44 clockwise or to its open position. During movement to its open position, the yoke 44 engages the projections 98 on the actuating lever 90 so as to return the lever 90 to its lower position and engages the projection 54 on the pivot lever 50 so as to return the pivot lever 50 to its lower position. When the actuating lever 90 moves to its lower position, the spring 122 permits the pivot lever 50 to "snap" past the D-shaped section 82 of the shaft 80 so that the pivot lever 50 can move to its first or lower position. The spring 122 also moves the lever 110 clockwise and thereby returns the shaft 80 to its retaining position so that the shaft 80 can retain the pivot lever 50 in its first position. Movement of the actuating lever 90 to its lower position permits the trip lever 70 to return to its retaining position under the influence of the spring 128 so that the trip lever 70 retains the actuating lever 90 in its lower position. Once the pivot lever 50 is retained in its lower position, the yoke 44 is moved counter-clockwise or to its closed position. This operates as described above to move the switch-operating lever 38 to its closed position and thereby to close the interrupter 6.

It should be noted that the shaft 80 retains the pivot lever 50 in its lower position and the force needed to move the shaft 80 from its retaining position is provided by the spring 100. The trip lever 70 only retains the actuating lever 90 against the force of the spring 100, and the sensor-tripper 150 only has to move the trip lever 70 enough to release the actuating lever 90. Therefore, the magnetic force required from the sensor-tripper 150 is minimized.

Figures 7, 8:
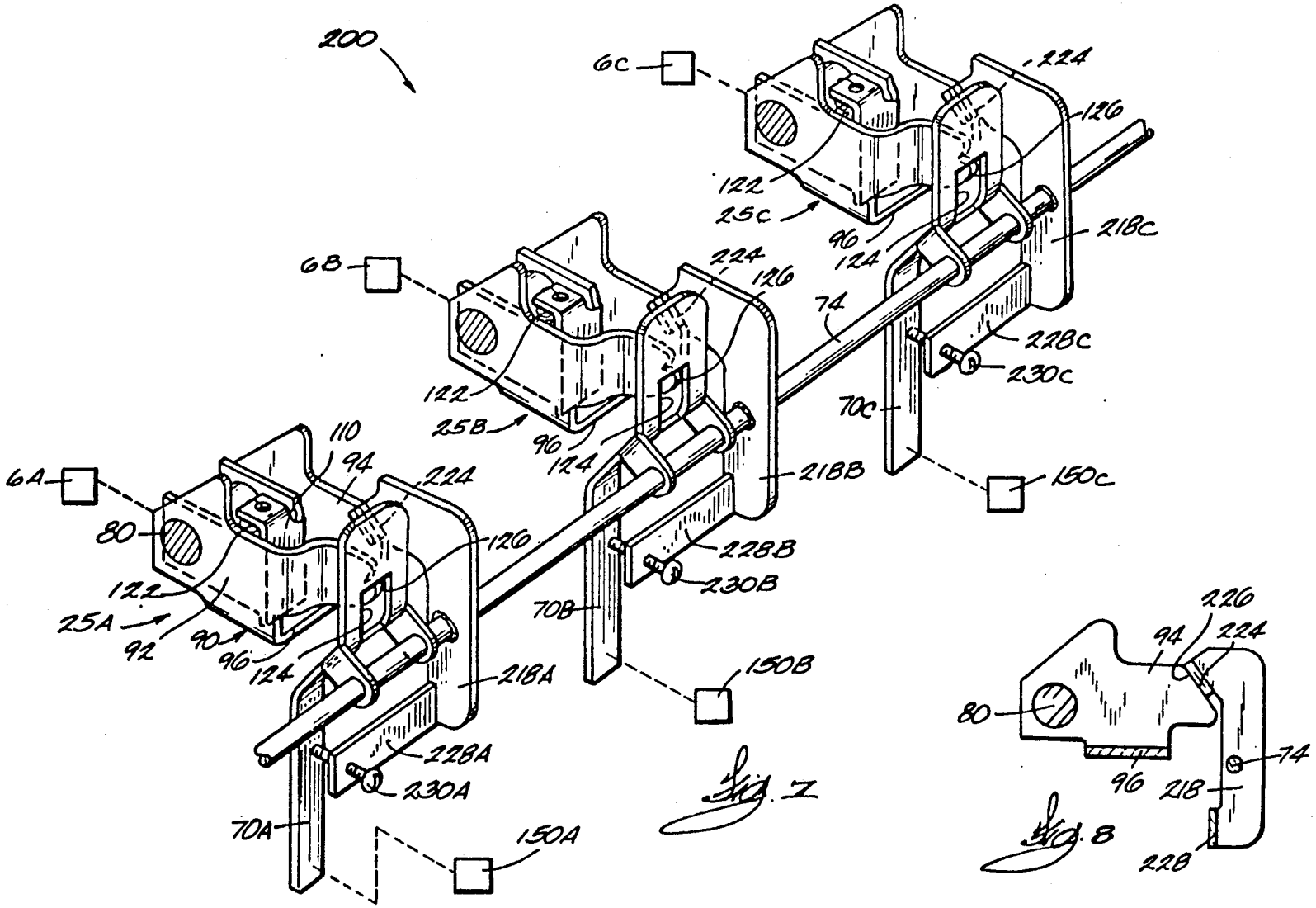
FIG. 7 is a perspective, schematic view of a second apparatus embodying various features of the invention.
FIG. 8 is a partial, cross-sectional view of the first apparatus.

Illustrated in FIG. 7 is a three-phase electrical apparatus 200 comprising first, second and third-phase circuits respectively including first, second and third interrupters 6A, 6B and 6C (shown schematically). The apparatus 200 also comprises first, second and third manually operable interrupter actuators 25A, 25B and 25C (partially shown) respectively connected to the interrupters 6A, 6B and 6C. The actuators 25A, 25B and 25C are substantially identical to the actuator 25 of the preferred embodiment, and common elements have been given the same reference numerals. Thus, the actuators 25A, 25B and 25C respectively include first, second and third fault sensing means, i.e. sensor-trippers 150A, 150B and 150C, respectively connected to the first, second and third circuits. As described above, each of the actuators 25A, 25B and 25C also includes means for opening the associated interrupter in response to pivotal movement of the associated one of the trip levers 70A, 70B and 70C.

The apparatus 200 also comprises means for actuating all three of the operating mechanisms or actuators 25A, 25B and 25C to open all three of the interrupters 6A, 6B and 6C in response to detection of a fault by any one of the sensor-trippers 150. While various suitable actuating means can be employed, in the illustrated construction, such means includes the above-mentioned shaft 74 which is pivotally mounted on the frames 30 of the actuators 25A, 25B and 25C. The trip levers 70A, 70B and 70C are pivotally mounted on the shaft 74 for independent rotation relative thereto. Thus, pivotal movement of any one of the trip levers 70A, 70B and 70C caused by the associated sensor-tripper 150 will cause that trip lever 70 to rotate relative to the shaft 74 but will not directly cause the shaft 74 to rotate. The actuating means also includes first, second and third driving levers 218A, 218B and 218C fixed to the shaft 74 for common rotation therewith. In other words, rotation of any one of the driving levers 218 causes common rotation of the shaft 74 and of the other two driving levers 218.

The actuating means also includes means for causing pivotal movement of the driving lever 218A in response to pivotal of the trip lever 70A, means for causing pivotal movement of the driving lever 218B in response to pivotal movement of the trip lever 70B, and means for causing pivotal movement of the driving lever 218C in response to pivotal movement of the trip lever 70C. While various suitable means can be used, in the illustrated construction, such means includes, on each of the actuators 25A, 25B and 25C, the portion 94 of the lever 90. The portion 94 has thereon (see FIG. 8) a cam surface 224 which is engageable with a cam surface 226 on the associated driving lever 218 to cause clockwise pivotal movement of the driving lever 218 in response to counter-clockwise movement of the lever 90. As described above, the lever 90 moves counter-clockwise when the associated actuator is tripped in response to pivotal movement of the associated trip lever 70. Therefore, each actuator 25A, 25B and 25C includes means for causing pivotal movement of the associated driving lever 218 in response to pivotal movement of the associated trip lever 70.

The actuating means also includes means for causing pivotal movement of the trip lever 70A in response to pivotal movement of the driving lever 218A, means for causing pivotal movement of the trip lever 70B in response to pivotal movement of the driving lever 218B, and means for causing pivotal movement of the trip lever 70C in response to pivotal movement of the driving lever 218C. While various suitable means can be employed, in the illustrated construction, each driving lever 218 has thereon a laterally extending projection 228 supporting a bolt or member 230 which is engageable with the associated trip lever 70 to cause clockwise pivotal movement of the trip lever 70 in response to clockwise pivotal movement of the driving lever 218, and which permits clockwise pivotal movement of the associated trip lever 70 independently of the driving lever 218.

Furthermore, as described above, each actuator includes sensor means (i.e., the associated sensor-tripper 150) for causing pivotal movement of the associated trip lever 70 in response to a fault in the associated circuit. Accordingly, the apparatus 200 comprises sensor means for causing pivotal movement of the trip lever 70A in response to a fault in the first circuit, sensor means for causing pivotal movement of the trip lever 70B in response to a fault in the second circuit, and sensor means for causing pivotal movement of the trip lever 70C in response to a fault in the third circuit.

Thus, when any one of the sensor-trippers 150 detects a fault in the associated circuit, the sensor-tripper 150 causes pivotal movement of the associated trip lever 70. This in turn trips the associated actuator 25 and thereby causes counter-clockwise pivotal movement of the associated lever 90. This in turn causes clockwise pivotal movement of the associated driving lever 218 and thereby causes clockwise pivotal movement of the shaft 74 and of the other two driving levers 218. The other two driving levers 218 cause clockwise pivotal movement of the associated trip levers 70 and thereby trip the other two actuators 25.

The advantage of this arrangement is that each sensor-tripper 150 requires only enough force to move the associated trip lever 70. The force required to move the other two trip levers 70 is provided by the spring 100 associated with the first actuator to be tripped.

Various features of the invention are set forth in the following claims.

We claim:

1. An interrupter actuator comprising
a frame,
means defining an axis, said axis defining means being selectively movable relative to said frame,
an operating lever pivotally movable about the axis defined by said axis defining means,
manually operable means for causing pivotal movement of said lever about the axis defined by said axis defining means,
means for opening and closing an interrupter in response to pivotal movement of said lever about the axis defined by said axis defining means,
selectively releasable means for retaining said axis defining means against movement relative to said frame irrespective of operation of said manually operable means, and
means for opening the interrupter in response to the release of said selectively releasable means.

2. An actuator as set forth in claim 1 wherein said means for opening and closing the interrupter includes a switch lever pivotally mounted on said frame, means connecting said switch lever to the interrupter, a link connector to said operating lever and to said switch lever, and a compression spring mounted on said link so as to bias the connection of said operating lever and said link away from the connection of said link and said switch lever.

3. An actuator as set forth in claim 1 wherein said selectively releasable means includes a pivot lever connected to said frame for pivotal movement relative thereto between first and second positions, and selectively releasable means for retaining said pivot lever in said first position, and wherein said operating lever is connected to said pivot lever for pivotal movement relative thereto about said axis.

4. An interrupter actuator comprising
a frame,
means defining an axis, said axis defining means being selectively movable relative to said frame,
an operating lever pivotally movable about the axis defined by said axis defining means,
spring means connected to said lever at a point spaced from said axis defining means,
selectively releasable means for retaining said axis defining means against movement relative to said frame,
manually operable means for causing pivotal movement of said lever about said axis, said manually operable means including means for moving said spring means over said axis defining means,
means for opening and closing an interrupter in response to pivotal movement of said lever about the axis defined by said axis defining means, and
means for opening the interrupter in response to the release of said selectively releasable means.

5. An actuator as set forth in claim 4 wherein said selectively releasable means includes a pivot lever connected to said frame for pivotal movement relative thereto between first and second positions, and selectively releasable means for retaining said pivot lever in said first position, and wherein said operating lever is connected to said pivot lever for pivotal movement relative thereto about said axis.

6. An actuator as set forth in claim 5 wherein said spring means biases said pivot lever to said second position.

7. An actuator as set forth in claim 6 wherein said means for moving said spring means over said axis includes an actuating member pivotally mounted on said frame, wherein said spring means is connected to said actuating member, and wherein said actuating member is pivotally moveable relative to said frame between a first position wherein said spring means biases said operating lever in one direction and a second position wherein said spring means biases said operating lever in the other direction.

8. An actuator as set forth in claim 5 wherein said means for opening and closing the interrupter includes a switch lever pivotally mounted on said frame, means connecting said switch lever to the interrupter, a link connected to said operating lever and to said switch lever, and a compression spring mounted on said link so as to bias the connection of said operating lever and said link away from the connection of said link and said switch lever.

9. An actuator as set forth in claim 5 wherein said means for retaining said pivot lever in said first position includes a trip lever mounted on said frame for movement between a retaining position and a non-retaining position, means for retaining said pivot lever in said first position when said trip lever is in said retaining position, and means for biasing said trip lever to said retaining position, and wherein said trip lever permits movement of said pivot lever to said second position when said trip lever is in said non-retaining position.

10. An actuator as set forth in claim 4 wherein said means for moving said spring means over said axis includes an actuating member pivotally mounted on said frame, wherein said spring means is connected to said actuating member, and wherein said actuating member is pivotally moveable relative to said frame between a first position wherein said spring means biases said lever in one direction and a second position wherein said spring means biases said lever in the other direction.

11. An interrupter actuator comprising
a frame, a pivot lever mounted on said frame for pivotal movement relative thereto about a first axis and between first and second positions, an operating lever mounted on said pivot lever for pivotal movement relative thereto about a second axis spaced from said first axis, and said operating lever being movable relative to said pivot lever between an open position and a closed position, and linkage means for opening an interrupter in response to movement of said operating lever when said pivot lever moves to said second position, for opening the interrupter in response to movement of said operating lever to said open position when said pivot lever is in said first position, and for closing the interrupter in response to movement of said operating lever to said closed position when said pivot lever is in said first position.

12. An interrupter operating apparatus adapted to be connected to first and second switches respectively connected to first and second circuits, said apparatus comprising a frame, first and second levers pivotally mounted on said frame for common rotation relative thereto, third and fourth levers pivotally mounted on said frame for independent rotation relative thereto, means for opening the first switch in response to pivotal movement of said third lever, means for opening the second switch in response to pivotal movement of said fourth lever, means for causing pivotal movement of said first lever in response to pivotal movement of said third lever, means for causing pivotal movement of said second lever in response to pivotal movement of said fourth lever, means for causing pivotal movement of said third lever in response to pivotal movement of said first lever, means for causing pivotal movement of said fourth lever in response to pivotal movement of said second lever, sensor means for causing pivotal movement of said third lever in response to a fault in the first circuit, and sensor means for causing pivotal movement of said fourth lever in response to a fault in the second circuit.

13. An apparatus as set forth in claim 12 and further comprising a shaft pivotally mounted on said frame, wherein said first and second levers are fixed to said shaft, and wherein said third and fourth levers are pivotally mounted on said shaft.

14. An interrupter actuator comprising a frame, an operating lever movable relative to said frame between an open position and a closed position, and means for opening an interrupter in response to movement of said operating lever to said open position, and for closing the interrupter in response to movement of said operating lever to said closed position, characterized in that said actuator further comprises a pivot lever mounted on said frame for pivotal movement relative thereto about a first axis and between first and second positions, said operating lever being mounted on said pivot lever for pivotal movement relative thereto about a second axis spaced from said first axis and between said open and closed positions, said means for opening and closing an interrupter causing opening of the interrupter in response to movement of said operating lever when said pivot lever moves to said second position, causing opening of the interrupter in response to movement of said operating lever to said open position when said pivot lever is in said first position, and causing closing of the interrupter in response to movement of said operating lever to said closed position when said pivot lever is in said first position.

15. An interrupter actuator comprising a frame, means defining an axis, said axis defining means being selectively movable relative to said frame, an operating lever pivotally movable about the axis defined by said axis defining means, spring means connected to said lever at a point spaced from said axis defining means, selectively releasable means for retaining said axis defining means against movement relative to said frame, said selectively releasable means including a pivot lever connected to said frame for pivotal movement relative thereto between first and second positions, and selectively releasable means for retaining said pivot lever in said first position, and said operating lever being connected to said pivot lever for pivotal movement relative thereto about the axis defined by said axis defining means, and said spring means biasing said pivot lever to said second position, manually operable means for causing pivotal movement of said operating lever about the axis defined by said axis defining means, means for opening and closing an interrupter in response to pivotal movement of said operating lever about the axis defined by said axis defining means, and means for opening the interrupter in response to the release of said selectively releasable means.

16. An interrupter actuator comprising a frame, means defining an axis, said axis defining means being selectively movable relative to said frame, an operating lever pivotally movable about the axis defined by said axis defining means, selectively releaseable means for retaining said axis defining means against movement relative to said frame, said selectively releaseable means including a pivot lever connected to said frame for pivotal movement relative thereto between first and second positions, and selectively releaseable means for retaining said pivot lever in said first position, said means for retaining said pivot lever in said first position including a trip lever mounted on said frame for movement between a retaining position and a non-retaining position, means for retaining said pivot lever in said first position when said trip lever is in said retaining position, and means for biasing said trip lever to said retaining position, said trip lever permitting movement of said pivot lever to said second position when said trip lever is in said non-retaining position, said operating lever being connected to said pivot lever for pivotal movement relative thereto about the axis defined by said axis defining means, manually operable means for causing pivotal movement of said lever about the axis defined by said axis defining means, means for opening and closing an interrupter in response to pivotal movement of said lever about the axis defined by said axis defining means, and means for opening the interrupter in response to the release of said selectively releaseable means.

17. An interrupter actuator comprising a frame, means supported by said frame and defining a first axis, a pivot lever mounted on said first axis defining means for pivotal movement relative to said frame, about the axis defined by said first axis defining means and between first and second positions, means supported by said lever, and defining a second axis spaced from the axis defined by said first axis defining means, an operating lever mounted on said pivot lever by said second axis defining means for pivotal movement relative to said pivot lever, about the axis defined by said second axis defining means, and said operating lever being movable relative to said pivot lever between an open position and a closed position, linkage means for opening an interrupter in response to movement of said operating lever when said pivot lever moves to said second position, for opening the interrupter in response to movement of said operating lever to said open position when said pivot lever is in said first position, and for closing the interrupter in response to movement of said operating lever to said closed position when said pivot lever is in said first position, means for biasing said pivot lever to said second position, means for releasably retaining said pivot lever in said first position, manually operable means for moving said operating lever between said open and closed positions, and means for releasing said retaining means in response to a fault in a circuit connected to the interrupter.

18. Electrical apparatus comprising first and second circuits respectively including first and second interrupters, first and second manually operable operating mechanisms respectively connected to said first and second interrupters and respectively including first and second fault sensing means respectively connected to said first and second circuits, and means for actuating both of said first and second operating mechanisms to open both of said first and second interrupters in response to detection of a fault by either of said first and second sensing means, said actuating means including a frame, a shaft pivotally mounted on said frame, first and second levers fixed to said shaft for common rotation therewith, third and fourth levers mounted on said shaft for independent rotation relative thereto, means for actuating said first mechanism to open said first interrupter in response to pivotal movement of said third lever, means for actuating said second mechanism to open said second interrupter in response to pivotal movement of said fourth lever, means for causing pivotal movement of said first lever in response to pivotal movement of said third lever, means for causing pivotal movement of said second lever in response to pivotal movement of said fourth lever, means for causing pivotal movement of said third lever in response to pivotal movement of said first lever, means for causing pivotal movement of said fourth lever in response to pivotal movement of said second lever, sensor means for causing pivotal movement of said third lever in response to a fault in said first circuit, and sensor means for causing pivotal movement of said fourth lever in response to a fault in said second circuit.

19. An interrupter actuator comprising a frame, means defining an axis, said axis defining means being selectively movable relative to said frame, an operating lever pivotally movable about the axis defined by said axis defining means, said axis defining means being movable between first and second positions, selectively releasable means for retaining said axis defining means in said first position and against movement relative to said frame, manually operable means for opening and closing an interrupter when said axis defining means is in said first position, and means for opening the interrupter in response to the release of said selectively releasable means and movement of said axis defining means to said second position.

* * * * *